US010844583B2

(12) United States Patent
Haeussler et al.

(10) Patent No.: US 10,844,583 B2
(45) Date of Patent: Nov. 24, 2020

(54) DRAIN SIEVE FOR A WASHBASIN

(71) Applicant: SIEMENS MOBILITY GMBH, Munich (DE)

(72) Inventors: Andreas Haeussler, Solingen (DE); Christopher Schatton, Viersen (DE); Christian Schneider, Dinslaken (DE)

(73) Assignee: Siemens Mobility GmbH, Munich (DE)

( * ) Notice: Subject to any disclaimer, the term of this patent is extended or adjusted under 35 U.S.C. 154(b) by 70 days.

(21) Appl. No.: 16/333,478

(22) PCT Filed: Aug. 22, 2017

(86) PCT No.: PCT/EP2017/071107
§ 371 (c)(1),
(2) Date: Mar. 14, 2019

(87) PCT Pub. No.: WO2018/050405
PCT Pub. Date: Mar. 22, 2018

(65) Prior Publication Data

US 2019/0264431 A1 Aug. 29, 2019

(30) Foreign Application Priority Data

Sep. 16, 2016 (DE) ..... 10 2016 217 716

(51) Int. Cl.
*E03C 1/264* (2006.01)
*E03C 1/26* (2006.01)

(52) U.S. Cl.
CPC ..... *E03C 1/264* (2013.01); *E03C 1/26* (2013.01)

(58) Field of Classification Search
CPC ..... E03C 1/264; E03C 1/26
USPC ..... 4/287, 289
See application file for complete search history.

(56) References Cited

U.S. PATENT DOCUMENTS 951,795 A 3/1910 Berwanger
1,783,460 A * 12/1930 Brotz ..... E03C 1/23 4/689
2,317,707 A 4/1943 Yavitch
2,739,317 A * 3/1956 Abresch ..... E03C 1/264 4/679
3,570,022 A * 3/1971 Nealy ..... E03C 1/23 4/287

(Continued)

FOREIGN PATENT DOCUMENTS

DE 825830 C 12/1951
SU 11104 A1 9/1929
SU 14405 A1 3/1930

*Primary Examiner* — Huyen D Le
(74) *Attorney, Agent, or Firm* — Laurence Greenberg; Werner Stemer; Ralph Locher

(57) ABSTRACT

A drain sieve for a washbasin catches foreign objects with a specified minimum size. The drain sieve has an annular support surface to be supported on the washbasin in the region of a drain of the washbasin and a closed curved surface which lies below the support surface in the assembled state. A distance between the curved surface and the support surface depends on the size of the foreign bodies to be caught, and the drain sieve is configured such that the curved surface of the drain sieve is curved upwards in the assembled state. Openings for the outflow of the water are arranged between the outer lower edge of the curved surface and the support surface of the drain sieve.

14 Claims, 11 Drawing Sheets

(56) References Cited

U.S. PATENT DOCUMENTS

| | | | | |
|---|---|---|---|---|
| 4,320,540 | A * | 3/1982 | Leavens | A47K 1/14 4/287 |
| 6,058,526 | A * | 5/2000 | Parisi | E03C 1/23 4/287 |
| 2012/0005814 | A1 | 1/2012 | Escobar et al. | |
| 2013/0333106 | A1 | 12/2013 | Ychie et al. | |

* cited by examiner

DRAIN SIEVE FOR A WASHBASIN

BACKGROUND OF THE INVENTION

Field of the Invention

The invention relates to a drain sieve for a washbasin for catching foreign bodies of a predefined minimum size, having a convexly curved surface, as well as to a washbasin having a drain sieve according to the invention.

Washbasins having a basin which is upwardly open in an installed state and a drain opening at its lowest point, to which an outflow, for example in the form of an outflow pipe, connects, are widely known. They are also used in sanitary modules of rail vehicles. With the washbasin in the usual installed state, the drain comprises an opening with a mostly vertical opening axis. Oversized openings in the drain are to avoid foreign bodies, such as, for example, cigarette butts, being able to pass into the drain. Conventional drain sieves are consequently arranged in the region of the drain in order to catch foreign bodies of a predetermined minimum size. Also disclosed are drain shutoff devices which can be raised and lowered by means of a lifting mechanism. In the lowered state, they close the drain opening of the washbasin in a sealing manner. In the raised state, they enable water to flow out of the washbasin through a gap between their underside and the washbasin. As the gap also comprises predefined dimensions and serves for holding back larger foreign bodies, an open drain shutoff device also functions as a drain sieve. The drain can also be designated as an outflow.

If the user does not immediately hold his hands in the water jet, the water, which emerges from a water faucet arranged above the washbasin, is able to fall onto the concavely curved washbasin surface or onto a centrally arranged drain sieve or onto a drain shutoff device. In this case, splashes can occur and the water is distributed in the entire washbasin and, where applicable, on a washstand surrounding it. This can even result in the user being splashed, which is to be avoided where possible. The user should not get splashed by the running water, especially if he is just standing in front of the washbasin without washing his hands.

A convex surface allows the water to spray away to the side. The washbasin, however, is concavely curved. In the field of rail vehicles, attempts are made, as a result of the arrangement from water faucet to washbasin, to place the point of impact of the water jet centrally on the convexly formed drain sieve in order to reduce the splashing. Said drain sieve consists of a convex surface which is provided with holes so that the water is able to drain through the holes. It is precisely the holes in the drain sieve that are the cause of the splashing.

The hand-washing water is frequently provided in rail vehicles by means of a gravity-fed water system. The water comes out at varying strengths in dependence on the fill level of the tank. As a result, the point of impact in the washbasin changes frequently, which also results in splashes, as the ideal point of impact in the center of the washbasin is not attained.

Further solutions in rail vehicles work with a closed convex surface without holes—in the manner of a non-closed or non-closable drain shutoff device which has already been described above. This spherical cap is screw-connected on an attachment by way of a thread. The surface is arranged higher in the washbasin such that the water is able to drain under the edge of the attachment.

Both solutions ensure that the water which splashes away to the side strikes the washbasin surface before it is able to drain away.

Documents U.S. Pat. No. 2,317,707 A, US 2012/0 005 814 A1, US 2013/0 333 106 A1 and DE 825 830 B disclose generic drain sieves, showing in each case a surface for abutment on the washbasin in the region of a drain of the washbasin and a curved surface, which curved surface of the drain sieve can be curved toward the bearing surface of the drain sieve. The curved surface comprises in each case openings for the passage of water, the size of said openings being dependent on the predefined minimum size of the foreign bodies which are to be caught by the drain sieve. The bearing surface and the curved surface merge continuously into one another.

SUMMARY OF THE INVENTION

The object underlying the invention is to avoid lateral splashes.

The object is achieved by the subject matter of the independent claim. Further developments and designs of the invention can be found in the features of the dependent claims.

A drain sieve according to the invention for a washbasin for catching foreign bodies of a predefined minimum size comprises a curved surface and includes a bearing surface for abutment on the washbasin in the region of a drain of the washbasin, wherein the bearing surface opens the drain of the washbasin at least in part for the passage of water, wherein the drain sieve is realized in such a manner that the curved surface of the drain sieve is curved toward the bearing surface of the drain sieve and that the curved surface of the drain sieve is at a predefined distance greater than zero from the bearing surface of the drain sieve. The curved surface comprises at least one edge which, at least at one point, is at a distance greater than zero from an edge of the bearing surface. The curved surface of the drain sieve can also comprise several edges which are each at a predefined distance greater than zero from the bearing surface of the drain sieve.

The drain sieve is provided to be used in a washbasin, in particular in a drain of a washbasin, and serves there for catching foreign bodies of a predefined minimum size. It comprises a curved surface for this purpose. The drain sieve is thus insertable into the washbasin, in particular is thus insertable into the drain of the washbasin and is to be inserted in accordance with its intended use or inserted in a provided installed state such that the curved surface of the drain sieve is arranged at least in part, in particular entirely in the drain of the washbasin and points upward into the washbasin and consequently to the user of the washbasin. The curvature points outward, to the user. It can consequently also be designated as convex.

In the predefined installed position, the curved surface points in the opposite direction to a main drainage direction and consequently away from the outflow, in particular from the drain pipework which is connected to the drain of the washbasin and toward the user, the curved surface and the bearing surface facing one another. In the predefined installed position, the curved surface of the drain sieve is curved toward the user and toward the bearing surface of the drain sieve and is consequently curved convexly.

The curved surface conceals the free cross section of the drain at least in part. The drain sieve thus includes a bearing surface for abutment on the washbasin in the region of the drain of the washbasin. This serves for inserting the drain sieve into the washbasin and for supporting the drain sieve on the washbasin.

In the region of the drain, the bearing surface comprises an opening for the passage of water which opens the drain at least in part. The bearing surface is realized, for example, in a ring-shaped manner. The drain sieve rests by way of its bearing surface on the washbasin, in particular on the bottom of the washbasin and around a drain opening of the washbasin. The bearing surface and the washbasin consequently touch each other. The opening for the passage of water is arranged above the drain such that said drain is opened at least in part by the opening. The bearing surface is consequently turned away from a user of the washbasin who sees the drain from above; the curved surface of the drain sieve, in contrast, is facing him. Said curved surface is consequently also curved toward the bearing surface.

Both the curved surface and the bearing surface are each delimited by at least one edge or by in each case several edges. The at least one edge of the curved surface, at least at one point, is at a distance greater than zero from at least one edge of the bearing surface which faces it. If the bearing surface is realized in a ring-shaped manner, the at least one edge of the curved surface, at least at one point, is at a distance greater than zero from at least one edge of the bearing surface which delimits the opening for the passage of water of the bearing surface. This could also be designated as an inner edge, the one located opposite it as an outer edge. The distance between the curved surface of the drain sieve and the bearing surface greater than zero is measured in particular in the vertical direction in the predefined installed position.

In an exemplary embodiment, the projection of the curved surface into a projection plane parallel to the bearing surface lies entirely within the projection of the bearing surface into said same projection plane. The bearing surface, in this case, spans a plane or it is even realized in a substantially flat manner. For example, a direction of draining is perpendicular to the plane of the bearing surface. In an installed state, the direction of draining extends, in this case, perpendicular to the surface of the earth and consequently in the direction of the effect of the force of gravity. In this case, the bearing surface then rests horizontally on the washbasin. The projection is consequently effected vertically into a horizontal projection plane. The projection of the opening for the passage of water of the bearing surface can be equal to the projection of the curved surface. The projection of the at least one edge of the curved surface consequently coincides with the projection of the edge of the bearing surface, by means of which the opening for the passage of water of the bearing surface is delimited. Their distances in the horizontal direction are zero, or in other words, the edge of the curved surface and an edge of the ring-shaped bearing surface are realized in an aligned manner. In this case, the edges, however, at least at one point, are at a distance from one another in the vertical direction. However, their projections into the projection plane can also be at a distance to one another. At said point, the edges are then at a distance from one another in the horizontal direction. The curved surface fully conceals the free cross section of the drain in the projection plane where there is no horizontal distance. The bearing surface can also cover the drain at least in part in the direction of projection. If the opening for the passage of water and the drain of the washbasin are both designed in a circular manner, the diameter of the opening for the passage of water is smaller than the diameter of the drain, at least in the region of the drain opening of the washbasin. The drain surface is horizontally above or it projects into the projection of the free cross section of the drain. With a horizontal distance between the edges of the bearing surface and the curved surface of the drain sieve, the free cross section of the drain is only concealed in part by the curved surface. The distance, whether in the horizontal or vertical direction, between the edge of the curved surface and the in particular inner edge of the bearing surface is dependent on the predefined minimum size of the foreign bodies which are to be caught by the drain sieve.

According to a further development of the drain sieve according to the invention, the curved surface of the drain sieve is free of openings for the passage of water from the washbasin. The curved surface comprises a bore or a hole, for example centrally, in order to pass through fastening means. Once the fastening means is passed through the bore, it closes the bore in a substantial manner and consequently prevents a significant passage of water through the bore. This does not consequently apply as an opening for the passage of water from the washbasin into the drain.

The bearing surface can be realized in a ring-shaped manner. It consequently comprises an opening in the center of the ring for the passage of water, through which the drain of the washbasin is opened at least in part.

In a further development of the invention, it is provided that the curved surface and the bearing surface are connected together, for example by means of webs which are spaced apart from one another. The connection is such that it comprises at least one opening for the passage of water. If the webs, for example with the drain sieve in the predefined installed position, extend in the vertical direction and are spaced apart from one another by a distance greater than zero in the horizontal direction, an opening for the passage of water is consequently situated between two webs. The opening for the passage of water can be delimited downward by the curved surface of the drain sieve, upward by the bearing surface of the drain sieve and to the side by the webs. In particular, the edge of the curved surface is connected to the edges of the bearing surface which point to the opening for the passage of water. The curved surface can consequently be mounted in a suspended manner by means of the webs, it being suspended in particular by its edges.

Water or another fluid exits from the washbasin through the, for example circular, opening in the, for example ring-shaped, bearing surface and consequently also through the drain opening of the washbasin. With the washbasin in the predefined installed position and the drain sieve in the washbasin, it drains vertically downward. In this case, it impacts onto the upwardly curved surface of the drain sieve and as a result is deflected to the side. It can then flow with a horizontal directional component through the vertically extending openings for the passage of water between the curved surface of the drain sieve and the bearing surface of the drain sieve into the drain of the washbasin.

However, the water which impacts onto the curved surface of the drain sieve and is deflected to the side by the convex curvature, is not deflected back into the washbasin or even to the user but, as a result of the curved surface of the drain sieve being arranged at least in part in the drain of the washbasin, is deflected into the drain of the washbasin. This applies in particular to water from a water faucet above the washbasin which impacts onto the drain sieve from a greater fall height.

The at least one opening for the passage of water between the bearing surface and the curved surface of the drain sieve, for example between the webs, can be dimensioned such that spherical foreign bodies with a diameter of at least 7 mm would be caught by the drain sieve. The dimensions of the at least one opening for the passage of water between the bearing surface and the curved surface or the vertical and horizontal distances between the bearing surface and the curved surface or rather the webs, are to be designed in a corresponding manner.

In particular, the distance between the edge of the curved surface of the drain sieve and the bearing surface of the drain sieve, in particular the edges of the bearing surface pointing to the opening for the passage of water, is no more than 7 mm. A ring-shaped bearing surface only comprises a ring-shaped edge of the drain sieve which points to the opening for the passage of water. Said edge comprises—as the opening itself—the inside diameter of the ring.

If the curved surface, in turn, is realized in a circular manner, it also only comprises a circular edge. Said edge comprises the outside diameter of the curved surface.

The outside diameter of the curved surface, in this case, can be greater, smaller or, as stated above, equal to the inside diameter of the ring-shaped bearing surface or, in other words, the projection of the curved surface into a projection plane parallel to the bearing surface can be greater, smaller or equal to the surface of the opening for the passage of water of the bearing surface.

According to a further development of the invention, the covering of the projection of the curved surface into a projection plane parallel to the bearing surface and to the opening for the passage of water of the bearing surface is at least 90%, in particular 100%.

In a further development, the curved surface of the drain sieve assumes the form of part of a surface of an ellipsoid or part of a surface of a sphere. In the last-mentioned case, it is curved in a spherical manner and forms, for example, a spherical cap.

A washbasin according to the invention includes, in particular, at least one drain sieve according to the invention.

According to a further development, the curved surface of the drain sieve is arranged at least in part, in particular entirely in the drain of the washbasin and consequently, with the washbasin in the installed state, at least in part, in particular entirely below the drain opening of the washbasin. Then a chord, which extends in particular horizontally, between two points of the inner surface of the washbasin, which intersects a point of the curved surface of the drain sieve, does not exist.

The drain sieve is realized in an advantageous manner for the passage of water and is arranged in the drain such that the upwardly convex curved surface of the drain sieve, in particular the edges of the upwardly convex curved surface of the drain sieve, are at a predefined distance greater than zero from the drain in the horizontal direction. Said drain must be sufficiently dimensioned such that a predefined amount of water is able to drain away in a predefined period of time just as a result of the force of gravity.

According to a further development, the drain sieve is realized such that the curved surface assumes or covers at least 90% of the cross section of the drain of the washbasin.

According to a further development, the curved surface of the drain sieve comprises an inclination, wherein the drain sieve is arranged in such a manner in the washbasin that the inclination of the curved surface of the drain sieve points away from a predefined position of a user of the washbasin. Here the curved surface assumes, in particular, the form of part of a surface of an ellipsoid.

The convex form of the surface does not refer in said embodiment to a spherical cap or to a rotationally symmetrical element. It is also possible to modify the form such that a spherical cap, i.e. a rotationally symmetrical body, is not used but just part of an ellipsoid. Said part has an elevated part which falls away in all directions within the drain. Said part is arranged such that the high flank is arranged toward the passenger. The achievement here is that the water impacts onto the convex surface and splashes away from the passenger.

A rail vehicle according to the invention includes at least one washbasin according to the invention, in particular in a sanitary module of the rail vehicle. The washbasin with the drain sieve according to the invention is realized in a correspondingly suitable manner for installation and use in a rail vehicle.

According to a further development of the rail vehicle according to the invention, said rail vehicle includes a gravity fed water system. Water from a water outlet of a water faucet, which is arranged such that it is caught by the washbasin, flows out consequently only at a low water pressure.

According to a further development, the sanitary module is realized such that a water faucet is arranged in such a manner in the direction of the outlet of water out of the water faucet that the water out of the water faucet impacts onto the drain sieve. In particular, a water outlet of the water faucet is arranged perpendicularly above the drain sieve.

The drain sieve is realized in a convexly formed manner. In particular, holes in the outlet sieve are dispensed with—they are relocated to the sides. The convex surface lies below the bottom of the washbasin such that the water splashing away to the side is able to flow into the openings all around the impact surface. As a result of the height of the lateral gaps, the sieve function continues to be provided as the sieve should prevent objects, such as, for example, cigarette butts, passing into the spout.

A washbasin according to the invention with a drain sieve according to the invention can also be realized in one piece, for example produced by using additive production processes. The drain sieve is then connected to the washbasin in a joint-free manner. A bearing surface of the drain sieve for abutment on the washbasin in the region of a drain would then no longer be visible. A washbasin having a basin which is upwardly open when the washbasin is in a predefined installed state or in a predefined installed position, having a drain opening and having a drain sieve for catching foreign bodies of a predefined minimum size, which drain sieve comprises a curved surface which is upwardly curved when the washbasin is in the installed position, is also consequently according to the invention. According to the invention, the curved surface, with the washbasin in the installed state, is arranged at least in part below the drain opening of the washbasin.

The curved surface of the drain sieve is once again curved in the opposite direction to the draining direction of water in the washbasin and is consequently curved upward toward the user of the washbasin or upward toward the opening of the washbasin and is consequently convexly curved.

Said curved surface comprises an edge which is at a predefined distance greater than zero from the drain opening of the washbasin. The edge is arranged entirely below the drain opening of the washbasin. An apex of the curved surface can project out of the drain opening of the washbasin into the washbasin or can be flush with the drain opening of the washbasin, however in a further development it also extends below the drain opening of the washbasin such that the curved surface of the drain sieve is then arranged entirely below the drain opening of the washbasin.

The curved surface of the drain sieve is, in particular, freely accessible from the washbasin.

The basin itself is concave for catching water. Water comes into contact with an inner surface of the washbasin and flows along it to the drain opening. The drain opening connects directly to the inner surface of the washbasin. With the washbasin in the installed state, the inner surface delimits it upward toward the surrounding area and opens out in the drain opening. The drain opening is provided in the region of a bottom of the washbasin, in particular at the lowest point of the basin. The drain opening provides a bore in the inner surface of the basin. An outflow for draining the water can connect to said bore. A drain pipe is connected, as a rule, to the outflow of the washbasin below the washbasin in order to drain the water further. As a rule, the outflow extends in the vertical direction first of all. The drain sieve is then arranged in the washbasin such that its curved surface is arranged in the outflow. The upwardly convex surface of the drain sieve is consequently arranged in the drain in such a manner that it extends below the inner surface of the washbasin.

The invention permits numerous embodiments. It is explained in more detail by way of the following figures in each of which a design example is shown. Identical elements in the figures are provided with identical reference symbols.

DESCRIPTION OF THE INVENTION

Figure 1:
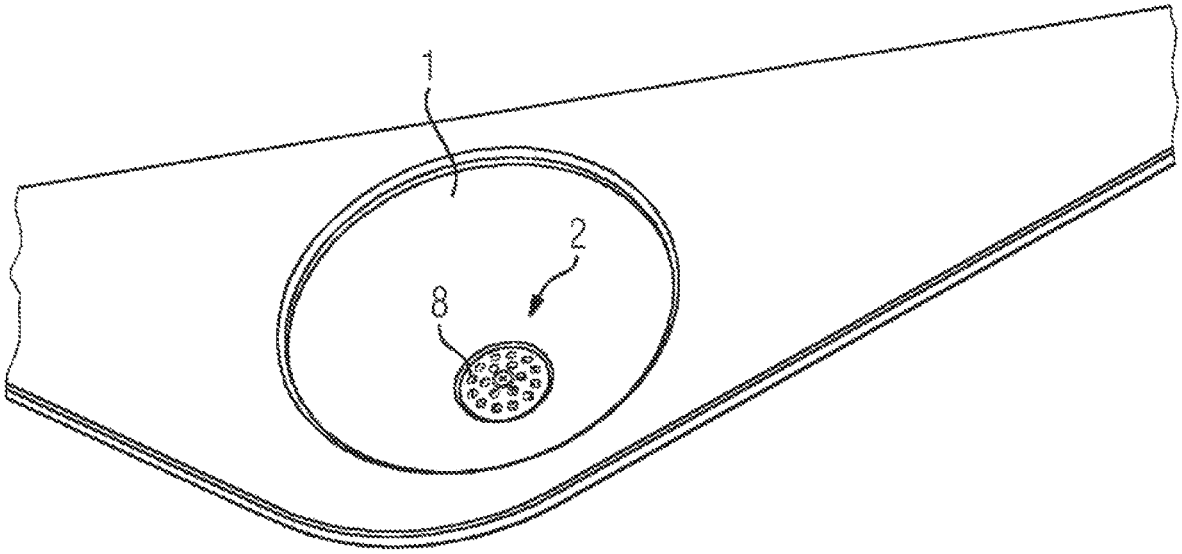
FIG 1 PRIOR ART
FIG. 1 shows a perspective representation of a washbasin with a drain sieve of the prior art.
Figure 2:
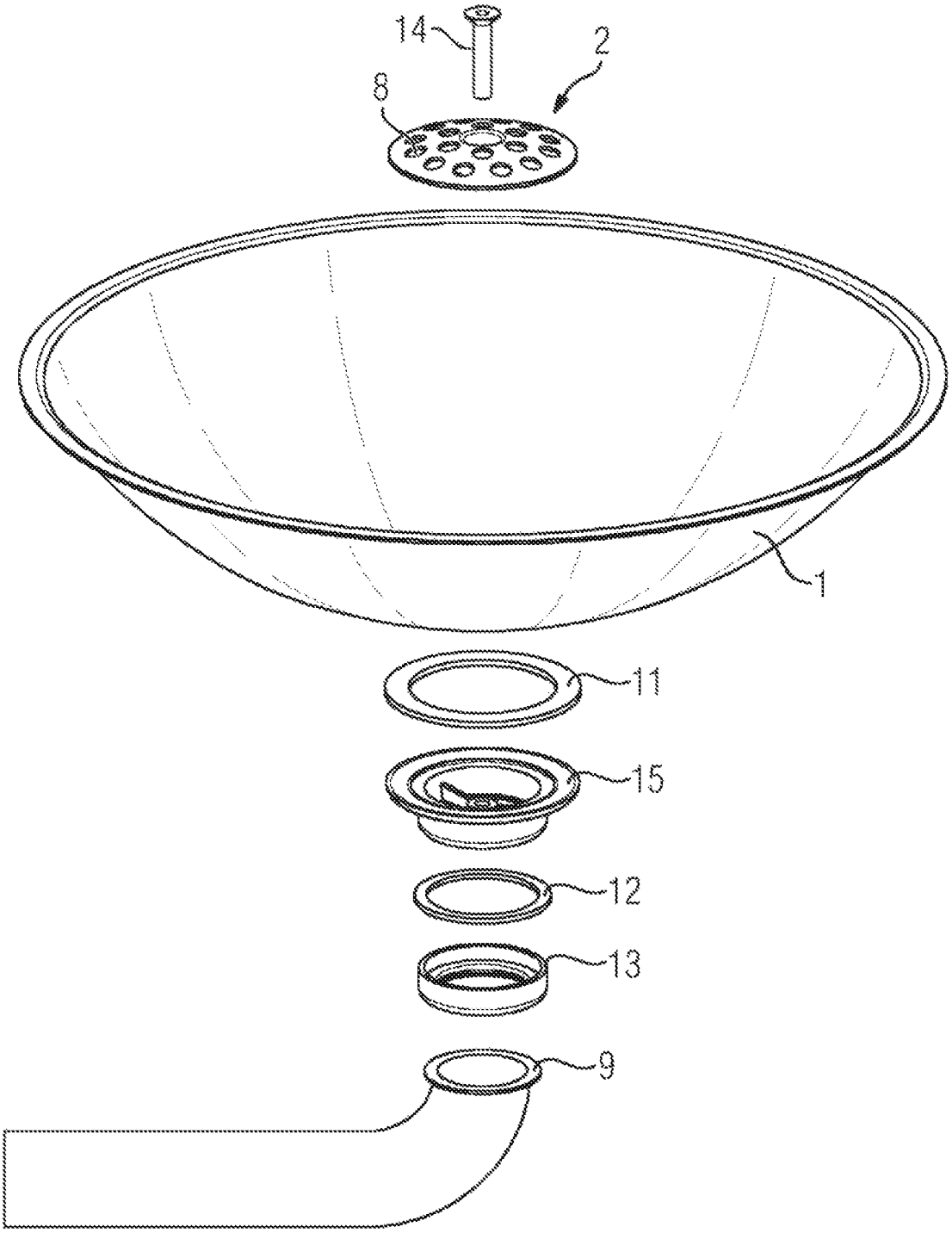
FIG 2 PRIOR ART
FIG. 2 shows an exploded representation of the washbasin from FIG. 1.
Figure 3:
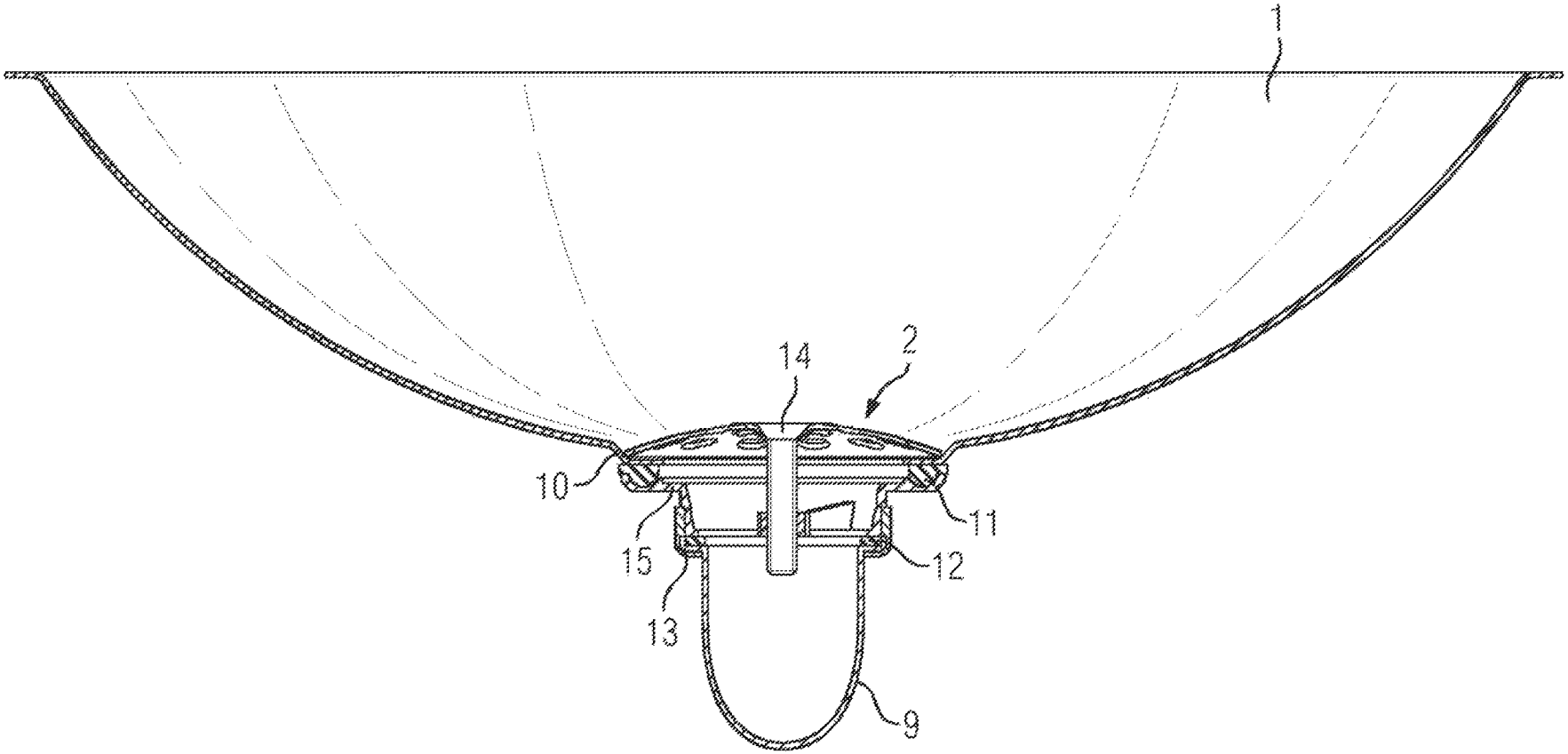
FIG 3 PRIOR ART
FIG. 3 shows a sectional representation of the washbasin from FIG. 1 in an installed situation.
Figure 4:
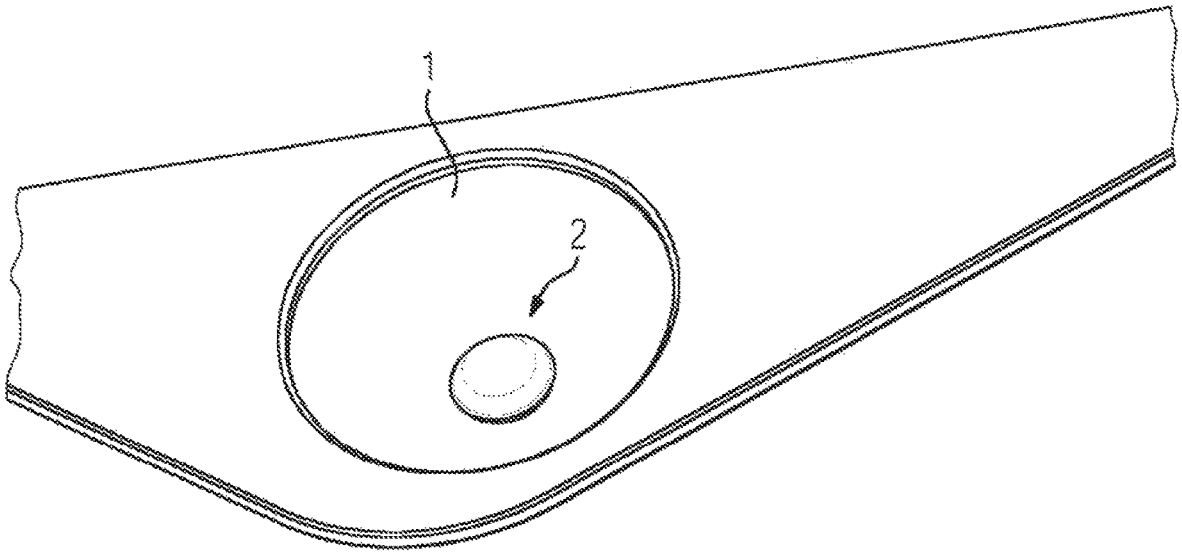
FIG. 4 shows a perspective representation of a further embodiment of a washbasin with a drain sieve of the prior art.
Figure 5:
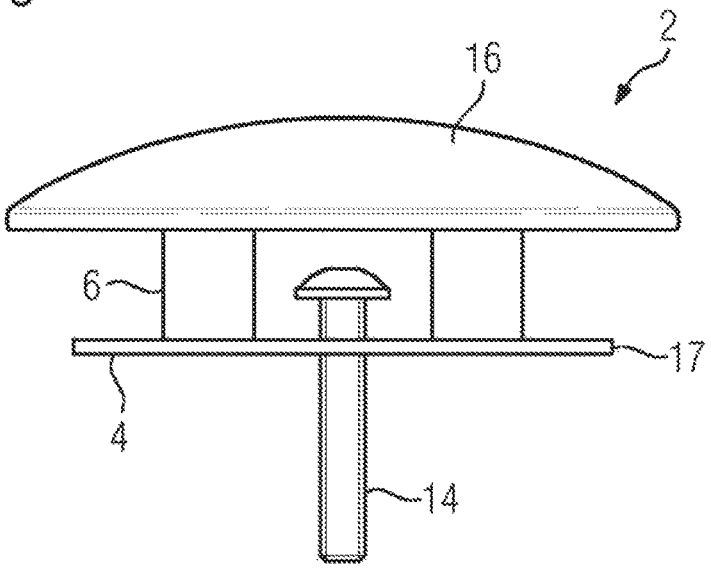
FIG. 5 shows the drain sieve from FIG. 4 from the side.

FIGS. 1 to 3 show a washbasin of the prior art—FIG. 1 in a three-dimensional view, FIG. 2 in an exploded representation to illustrate the individual components and FIG. 3 in a sectional representation. Said washbasin comprises a drain opening to which the drain connects in a direct manner.

In its installed position or position of use, the washbasin 1 comprises a drain opening at the lowest point of the washbasin 1 with a vertical opening axis. The drain opening is covered by means of a drain sieve 2. The drain sieve 2, however, comprises a plurality of openings 8 for the passage of water such that water is able to be discharged through the drain opening of the washbasin through the openings 8 in the drain sieve 2.

An outflow, here in the form of a drain pipe 9, is connected to the drain opening. The washbasin 1 illustrated here comprises a circumferential projection 10, on which the drain sieve 2 rests. The drain sieve 2 further includes a bearing surface for abutment on the projection 10 of the washbasin 1 in the region of the drain opening. This serves for inserting the drain sieve 2 into the washbasin and for supporting the drain sieve 2 on the washbasin 10. The drain opening of the washbasin 1 is delimited by the projection 10. A first seal 11, which is pre-stressed against the washbasin 1 by means of a drain sink 15, is arranged below the projection 10. The drain sink 15, in turn, is screw-connected to the drain sieve 2 by means of a fastening screw 14 and they are pre-stressed against one another. The fastening screw 14 coincides here with the vertical opening axis of the drain opening.

A seal 12, which is pre-stressed by means of a nut 13, is provided once again between the drain pipe 9 and the drain sink 15. For this purpose, the nut 13 encompasses a collar of the drain pipe 9 and comprises an internal thread which is screw-connected to an external thread of the drain sink 15.

Analogously to the embodiment according to FIGS. 1 to 3, FIGS. 4 and 5 show washbasins of the prior art. In contrast, the drain sieve 2 here, however, comprises a closed spherical cap. The spherical cap 16 is free of openings for the passage of water. The drain sieve 2 is divided into two parts. It includes the already mentioned spherical cap 16 and a lower part 17 which rests with the projection of the washbasin 1 and onto which the spherical cap 16 is fitted. The lower part comprises a bearing surface 4 and webs 6. The bearing surface 4 serves for the abutment of the drain sieve 2 on the projection of the washbasin 1 in the region of the drain opening. The bearing surface 4 is realized in a ring-shaped manner with a central opening for the passage of water. Said opening opens the drain opening of the washbasin 1 at least in part. A single web, which is not shown and, in turn, comprises an opening for passing through a fastening screw 14, is provided bridging the central opening. The webs 6 connect the bearing surface 4 to the spherical cap 16 which is fitted onto the webs 6 or onto a ring which connects the webs 6 and is not shown. The fastening screw 14 with the spherical cap 16 removed is thus also screw-connectable in the same way as in the preceding embodiment. Once this has been mounted successfully, the spherical cap 16 can be fitted. Passage of water through the drain opening is ensured by the distance between the outer edge of the spherical cap 16 and the washbasin 1 which is predetermined by the length of the webs 6.

Figure 6:
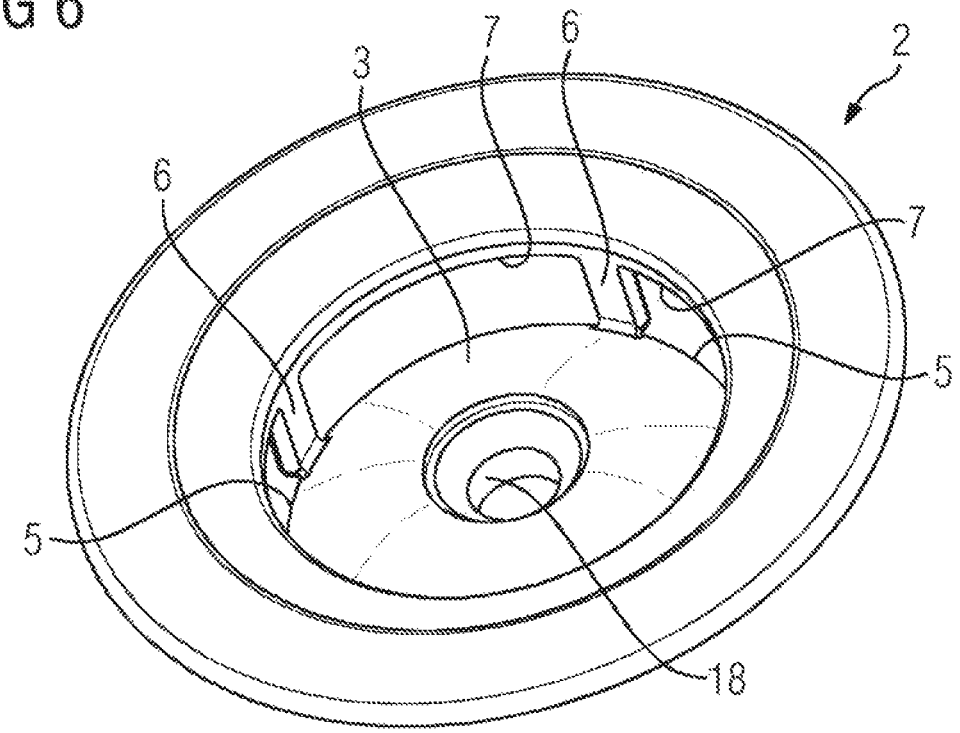
FIG. 6 shows a perspective representation of an embodiment of a drain sieve according to the invention.
Figure 7:
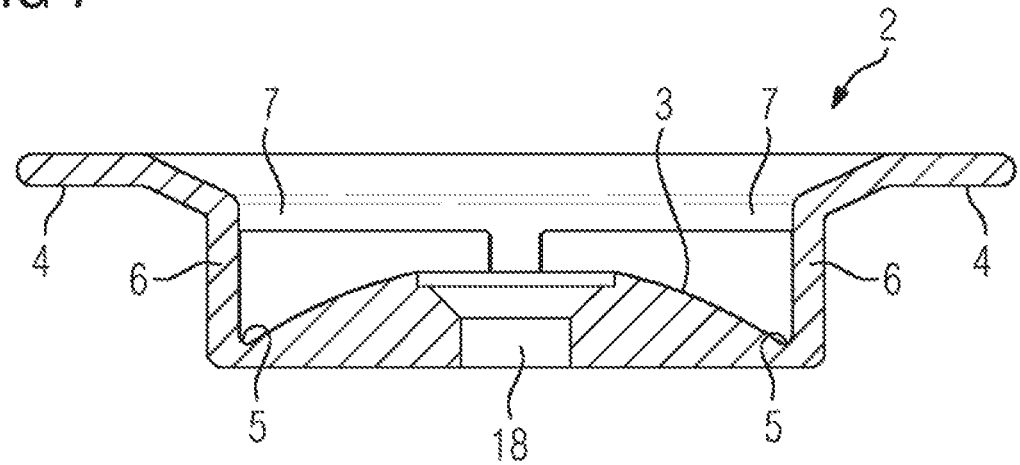
FIG. 7 shows the drain sieve from FIG. 6 from the side.

FIGS. 6 and 7 then show a drain sieve 2 according to the invention for a washbasin for catching foreign bodies of a predefined minimum size with a curved surface 3. The drain sieve 2 comprises a bearing surface 4 for abutment on the washbasin in the region of a drain of the washbasin, the bearing surface 4 opening the drain of the washbasin at least in part for the passage of water. According to the invention, this is achieved as a result of the drain sieve 2 being further realized in such a manner that the curved surface 3 comprises an edge 5 which is at a predefined distance greater than zero from the bearing surface 4 of the drain sieve 2.

Webs 6 are provided on the edge 5 here and the curved surface 3 is connected to the bearing surface 4 by means of said webs. The curved surface 3 of the drain sieve 2 is curved according to the invention from the edge 5 and toward the bearing surface 4 of the drain sieve 2. In this exemplary embodiment, it is realized in a ring-shaped manner with an inner edge 7 which delimits a central opening for the passage of water. The edge 5 of the curved surface 3 and the inner edge 7 of the ring-shaped bearing surface 4 are arranged in alignment with one another. The lengths of the webs 6, which are uniform here, fix the distance from the bearing surface 4 of the drain sieve. The webs 6 are arranged evenly distributed over the circumference of the curved surface 3. Water is able to drain between the webs 6 into the drain of the washbasin.

The drain sieve 2 is realized in such a manner that the curved surface 3 of the drain sieve 2 is convex toward the bearing surface 4 of the drain sieve 2. The convexly curved surface 3 is free of openings or holes for the passage of liquid out of the washbasin. It comprises a central bore 18 for passing through a simply fastening screw. Otherwise, it has the form of a spherical cap.

Figure 8:
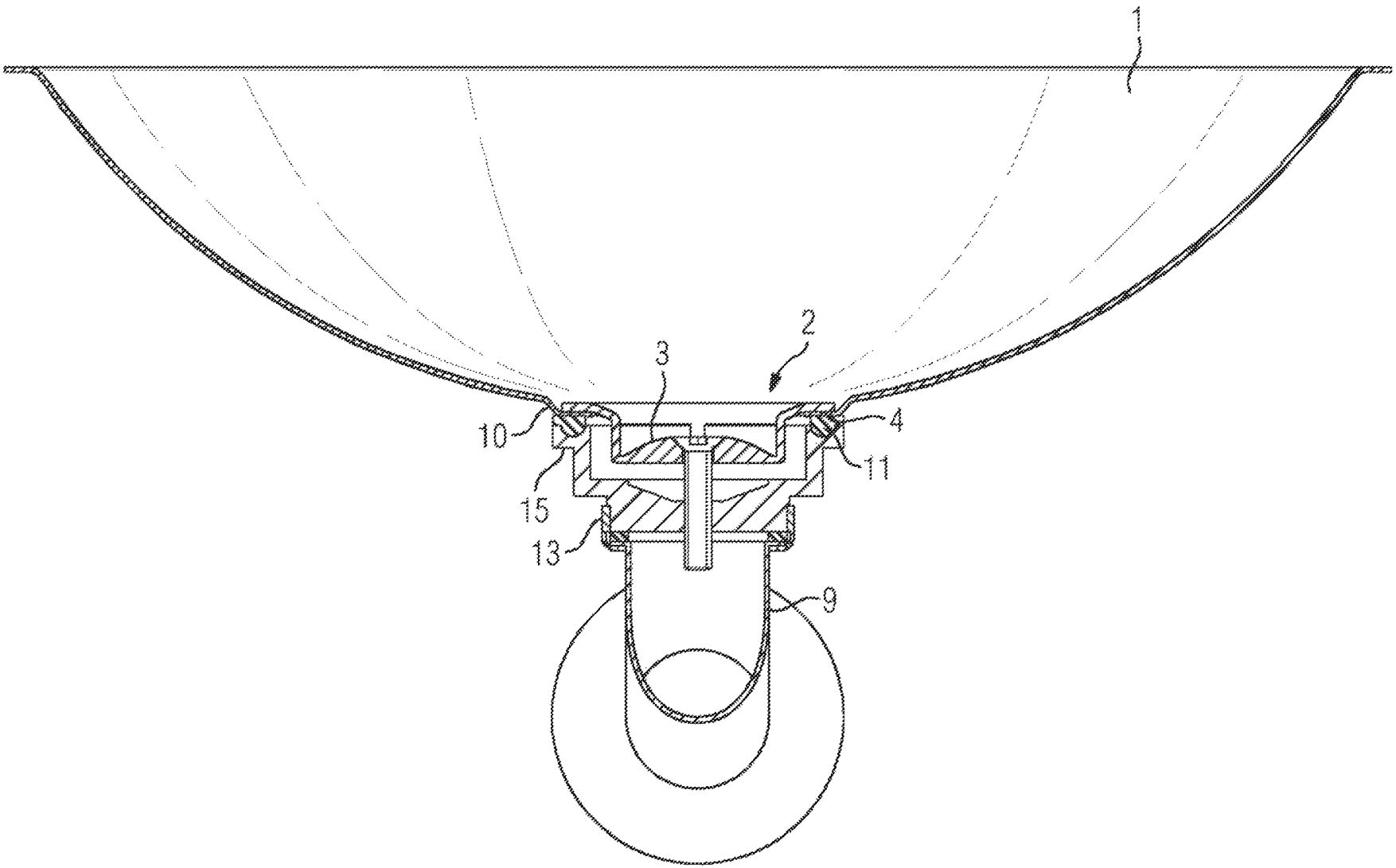
FIG. 8 shows a sectional representation of the drain sieve according to the invention from FIG. 6 in an installed situation in a washbasin.
Figure 9:
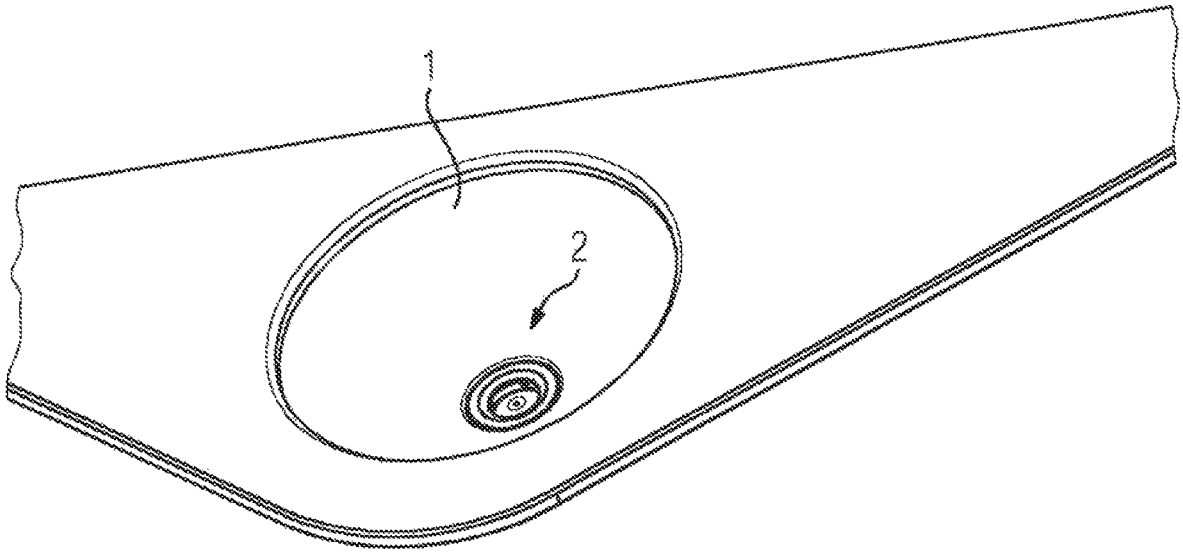
FIG. 9 shows a perspective representation of a washbasin with a drain sieve according to the invention from FIG. 6.

FIGS. 8 and 9 show the drain sieve 2 from FIGS. 6 and 7 in an installed position in the washbasin 1.

In its installed position or position of use, the washbasin 1 comprises a drain opening at the lowest point of the washbasin 1 with a vertical opening axis. The drain sieve 2 is inserted into the drain opening. The washbasin 1 illustrated here comprises, in the region of the drain opening, a circumferential projection 10 which connects to an inner surface of the washbasin 1, on which inner surface the drain sieve 2 rests by way of its ring-shaped bearing surface 4. The circumferential projection 10 delimits the drain opening and the bottom of the washbasin at the lowest point.

The curved surface 3 of the drain sieve 2 is curved convexly toward the bearing surface 4 and is introduced into the drain of the washbasin 1. It curves outwardly or upwardly toward the user of the washbasin 1 and consequently into the washbasin 1.

By way of arrows, FIG. 8 shows a schematic sketch of the course of water from a water faucet arranged above the washbasin 1. The water passes through the central opening of the drain sieve, which central opening is delimited by the ring-shaped bearing surface 4, and consequently also through the drain opening of the washbasin 1 and impacts on the curved surface 3 of the drain sieve 2. As a result, the water is deflected to the side toward the outlet sink 15 and not in the direction of the user. The water then drains downward in the direction of the drain pipe 9 through the openings between the webs 6 of the drain sieve and between an inner surface of the outlet sink 15 and the edge 5 of the curved surface 3 of the drain sieve 2. The deflecting and the outflow of the water through the openings between the webs 6 of the drain sieve 2 can be effected, in principle, radially in all directions in the plane perpendicular to the opening axis of the drain opening. How the draining is actually effected depends on the point of impact of the water on the curved surface.

Figure 10:
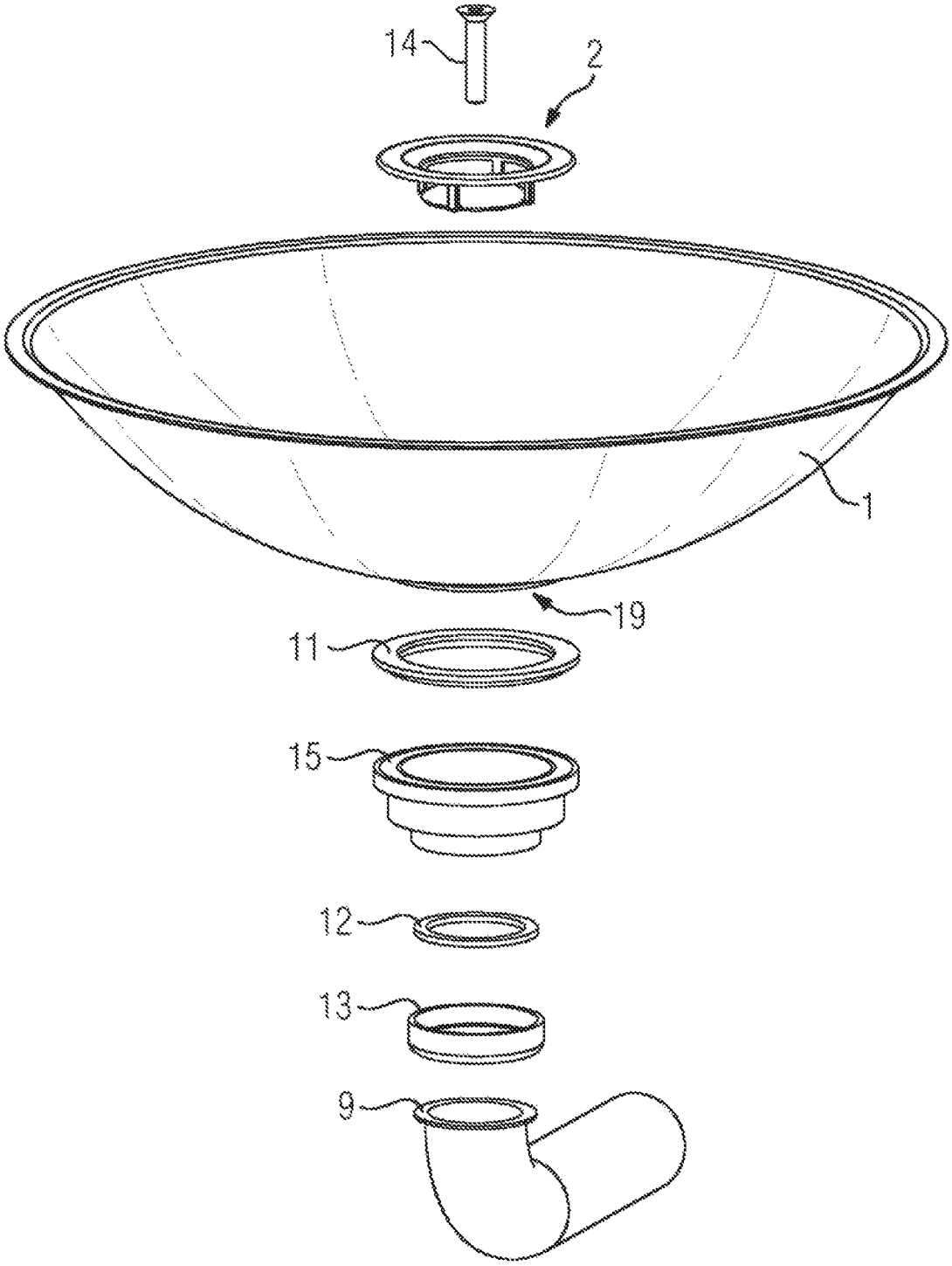
FIG. 10 shows an exploded representation of the washbasin from FIG. 9.
Figure 11:
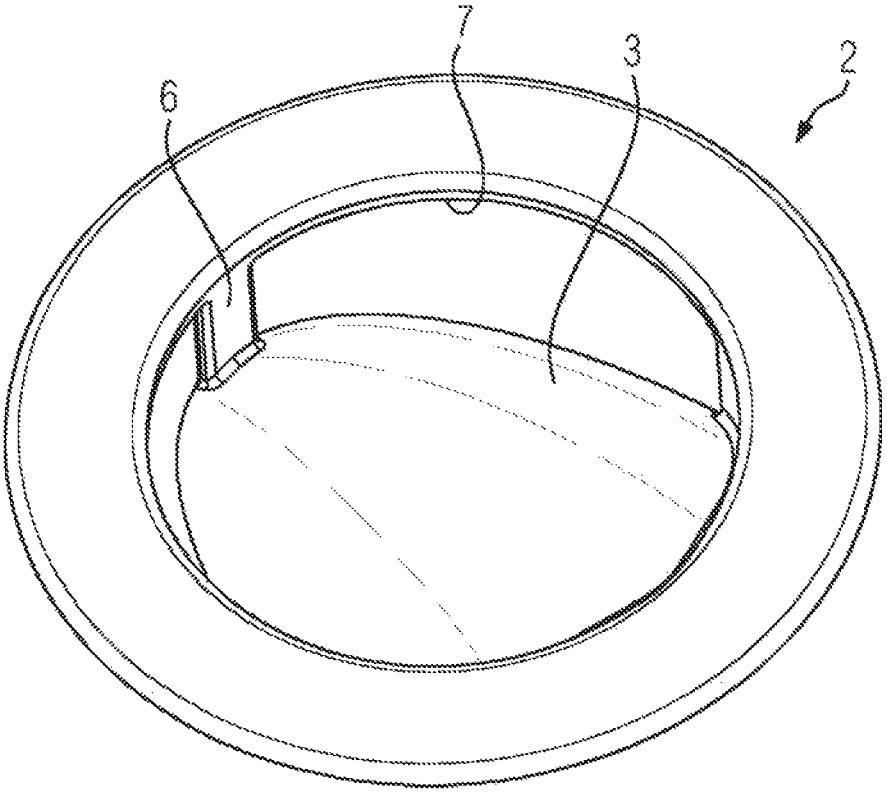
FIG. 11 shows a perspective representation of a further embodiment of a drain sieve according to the invention.
Figure 12:
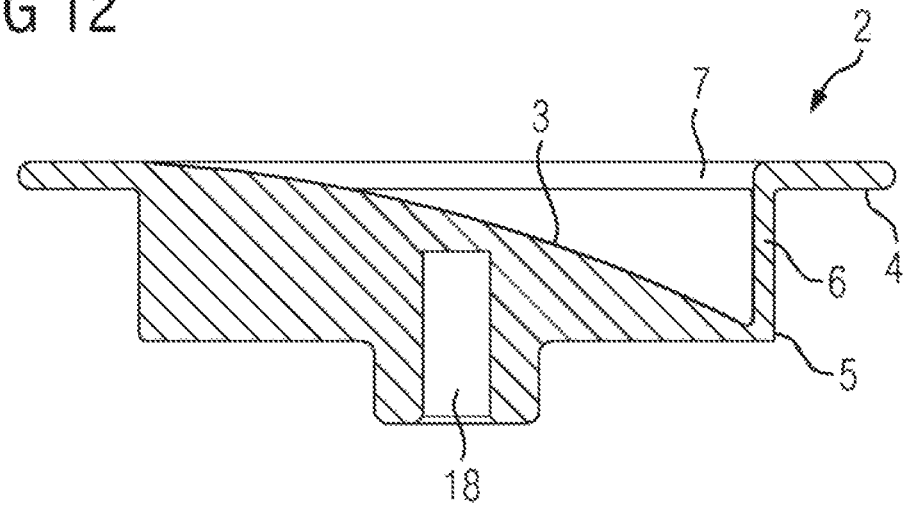
FIG. 12 shows a sectional representation of the drain sieve from FIG. 11.

FIG. 10 shows an exploded drawing analogous to FIG. 2 with the drain sieve according to the invention according to FIGS. 6 and 7 and further components. It is possible to see:

drain pipe 9
seal 11,
seal 12,
nut 13,
fastening screw 14,
outlet sink 15,
drain opening 19 of the washbasin 1.

The mounting of the drain sieve 2 with the washbasin and the drain pipe 9 is effected in an identical manner to the prior art.

Here too, the drain sieve 2 is inserted into the drain opening 19 of the washbasin 1. As known in the prior art, the outlet sink 15 is screw-connected to the drain sieve 2 by means of the fastening screw 14 and both components are pre-stressed against one another by interposing the seal 11. The fastening screw 14 coincides here with the vertical opening axis of the drain opening.

A further seal 12, which is pre-stressed by means of the nut 13, is provided between the drain pipe 9 and the outlet sink 15. The nut 13 encompasses a collar of the drain pipe 9 for this purpose and comprises an internal thread which is screw-connected to an external thread of the outlet sink 15.

The outlet sink 15 as part of the drain connects to the bottom of the washbasin 1 below the bottom of the washbasin. The drain pipe 9 connects, in turn, to the outlet sink 15.

FIGS. 11 to 14 illustrate various views of a further embodiment of a drain sieve according to the invention.

The curved surface 3 of the drain sieve 2 no longer comprises a through-bore for passing through a fastening screw 14. It is free of openings or holes. A blind hole 18 is provided instead.

Here too, the bearing surface 4 opens the drain of the washbasin at least in part for the passage of water out of the washbasin. To this end, the bearing surface 4, as known from the above designs, comprises an opening for the passage of water. The bearing surface 4 serves for abutment on the washbasin 1, opening the drain at least in part for the passage of water. It extends in a ring-shaped manner about the drain whilst abutting on the washbasin 1.

A further essential difference to the aforenamed embodiments is that the curved surface 3 is inclined on one side and no longer falls away radially in the form of a spherical cap starting from a center point in the direction of its edge 5.

The curved surface 3 extends in part above the bearing surface 4. Its edge extends at least at one point in alignment with the upper side of the bearing ring, the underside of which forms the bearing surface 4. The curved surface 3 falls away from there.

Nevertheless, the upwardly convex, curved surface 3 of the drain sieve 2 and the bearing surface 4 are now connected together, here once again by means of webs 6, in such a manner that the free edge 5 of the upwardly convex, curved surface 3 of the drain sieve 2 and the bearing surface 4 are at a predefined distance and do not fall below this, openings for the passage of water, here once again between the webs 6 which delimit them with respect to the opening for the passage of water, being realized between the upwardly convex surface 3, in particular its free edge 5, and the bearing surface 4. The majority of the curved surface 3, however, is once again arranged in the drain of the washbasin 1 below the drain opening.

Figure 13:
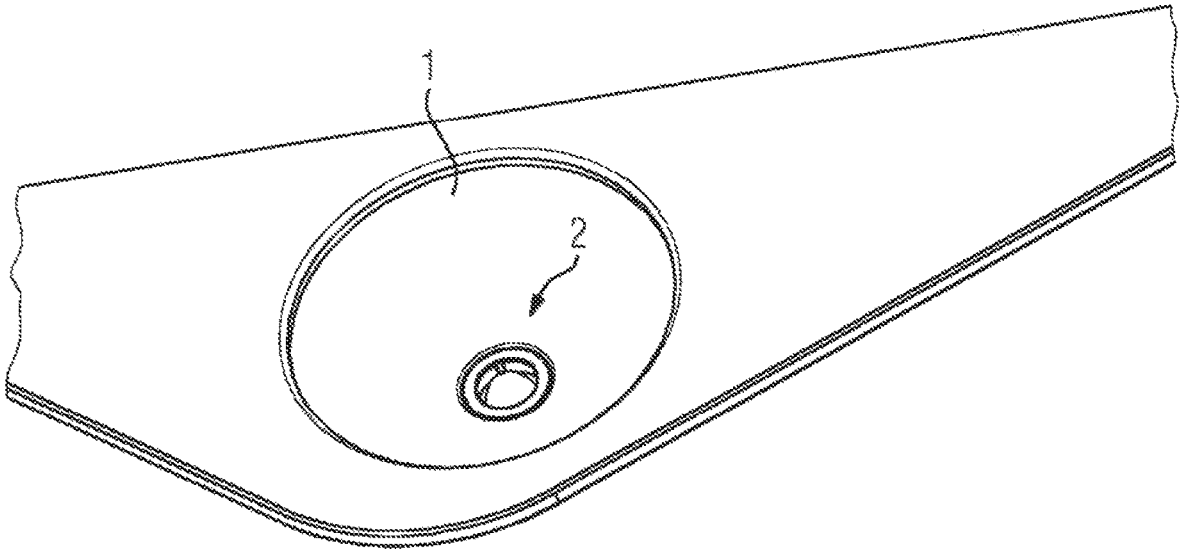
FIG. 13 shows a perspective representation of a washbasin with the drain sieve according to the invention from FIG. 11.

The drain sieve 2, in this case, is arranged in the washbasin such that the inclination of the curved surface 3 of the drain sieve 3 points away from a predefined position of a user of the washbasin 1 such that water impacting onto the curved surface is deflected away from the user, as indicated by way of arrows in FIG. 13.

Figure 14:
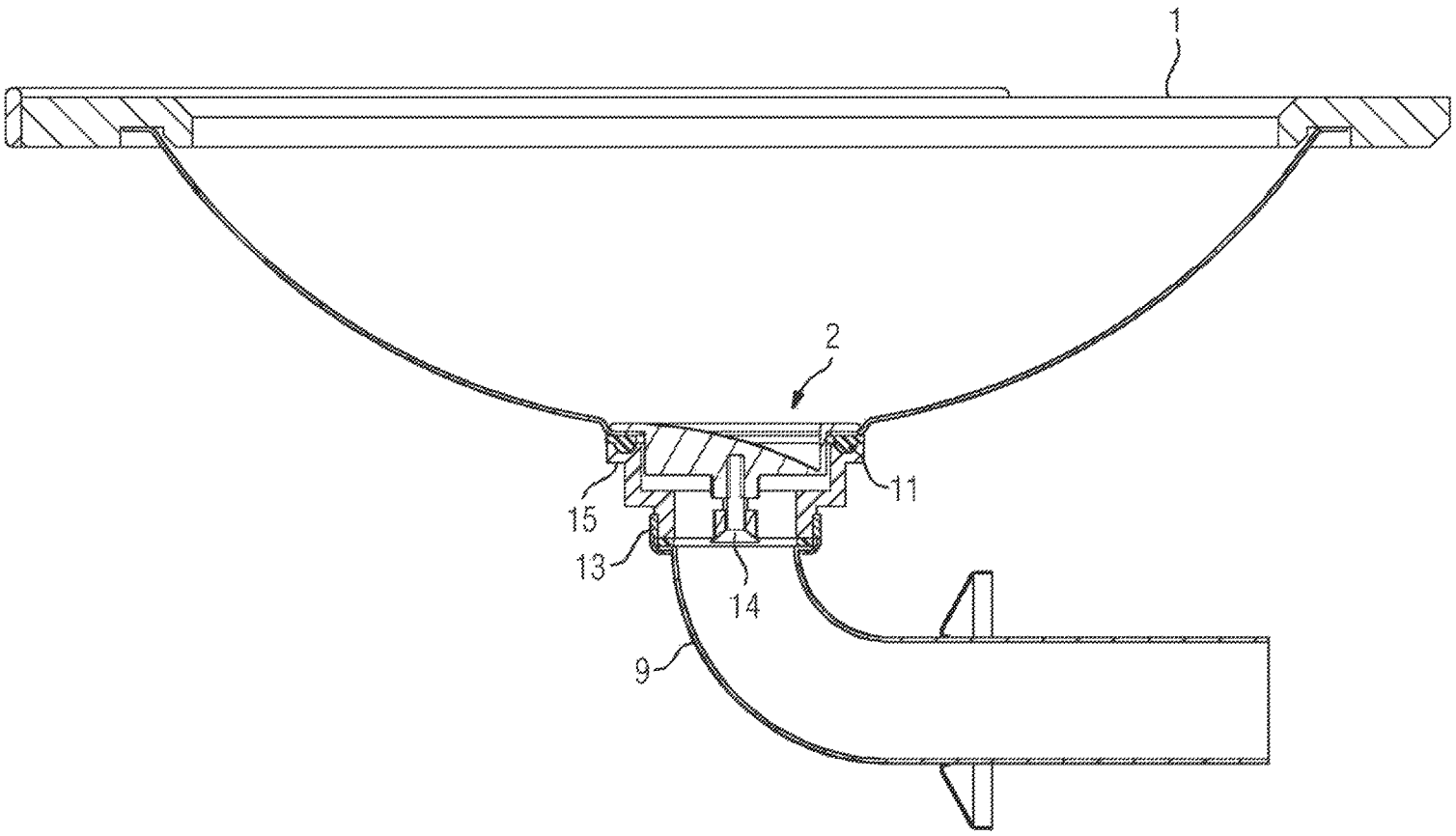
FIG. 14 shows a sectional representation of the drain sieve according to the invention from FIG. 11 in an installed situation in a washbasin.

The further water course is shown in FIG. 14.

The water passes through the central opening of the drain sieve 2, which is delimited by the ring-shaped bearing surface 4, and consequently also through the drain opening of the washbasin 1 and impacts onto the curved surface 3 of the drain sieve 2. As a result, the water is deflected on one side toward the side of the outlet sink 15 and from a position of the user in front of the washbasin. The water then drains downward in the direction of the drain pipe 9 through the openings between the webs 6 of the drain sieve 2 and between an inner surface of the outlet sink 15 and the edge 5 of the curved surface 3 of the drain sieve 2. The deflecting and the draining of the water through the openings between the webs 6 of the drain sieve 2 can be effected, in principle, only in the directions of the inclinations of the curved surface 3 in the plane perpendicular to the opening axis of the drain opening. How the draining is actually effected depends on the point of impact of the water on the curved surface.

The invention claimed is:

1. A drain sieve, comprising:

a curved surface for a washbasin for catching foreign bodies of a predefined minimum size;

a bearing surface for abutment on the washbasin in a region of a drain of the washbasin, said bearing surface being delimited by at least one edge facing said curved surface, said bearing surface opening into the drain of the washbasin at least in part for a passage of water, the drain sieve being realized in such a manner that said curved surface containing an edge delimiting the curved surface and said curved surface, at least at one point, is at a predefined distance greater than zero from said edge of said bearing surface, the predefined distance between said edge of said curved surface and the edge of said bearing surface is dependent on the predefined minimum size of the foreign bodies which are to be caught by the drain sieve; and said curved surface being curved toward said bearing surface.

2. The drain sieve according to claim 1, wherein said bearing surface is ring-shaped bearing surface.

3. The drain sieve according to claim 2, wherein the drain sieve is realized in such a manner that said edge of said curved surface and said edge of said ring-shaped bearing surface are realized so as to be aligned.

4. The drain sieve according to claim 1, wherein:

said curved surface and said bearing surface are connected together; and the drain sieve has at least one opening formed therein for the passage of the water between said curved surface and said bearing surface.

5. The drain sieve according to claim 4, further comprising webs, said curved surface and said bearing surface are connected together by means of said webs which are spaced apart from one another.

6. The drain sieve according to claim 1, wherein said curved surface is free of openings for the passage of the water.

7. The drain sieve according to claim 1, wherein said curved surface assumes a form of a part of a surface of an ellipsoid.

8. The washbasin according to claim 7, wherein said curved surface of said drain sieve has an inclination, said drain sieve is disposed in such a manner that the inclination of said curved surface of said drain sieve points away from a predefined position of a user of the washbasin.

9. The drain sieve according to claim 1, wherein said curved surface assumes a form of part of a surface of a sphere.

10. The drain sieve according to claim 1, wherein the predefined distance between said edge of said curved surface and said bearing surface is no more than 7 mm.

11. A washbasin, comprising:

a drain; and a drain sieve, containing:

a curved surface for catching foreign bodies of a predefined minimum size;

a bearing surface disposed in a region of said drain, said bearing surface being delimited by at least one edge facing said curved surface, said bearing surface opening into said drain at least in part for a passage of water, said drain sieve being realized in such a manner that said curved surface containing an edge delimiting said curved surface and said curved surface, at least at one point, is at a predefined distance greater than zero from said edge of said bearing surface, the predefined distance between said edge of said curved surface and said edge of said bearing surface is dependent on the predefined minimum size of the foreign bodies which are to be caught by said drain sieve; and said curved surface being curved toward said bearing surface.

12. The washbasin according to claim 11, wherein said curved surface of said drain sieve is disposed entirely in said drain.

13. The washbasin according to claim 11, wherein said drain sieve is disposed in such a manner in said drain that said edge of said curved surface of said drain sieve is at a defined distance greater than zero from said drain in a horizontal direction.

14. The washbasin according to claim 13, wherein the predefined distance between said edge of said curved surface of said drain sieve and said drain is no more than 7 mm.

* * * * *